US009373890B2

(12) United States Patent
Park

(10) Patent No.: US 9,373,890 B2
(45) Date of Patent: Jun. 21, 2016

(54) ANTENNA

(71) Applicant: LG INNOTEK CO., LTD., Seoul (KR)

(72) Inventor: Young Hun Park, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 189 days.

(21) Appl. No.: 13/631,435

(22) Filed: Sep. 28, 2012

(65) Prior Publication Data

US 2013/0076588 A1 Mar. 28, 2013

(30) Foreign Application Priority Data

Sep. 28, 2011 (KR) ..... 10-2011-0098610

(51) Int. Cl.

| | |
|---|---|
| ***H01Q 1/50*** | (2006.01) |
| ***H01Q 9/16*** | (2006.01) |
| ***H01Q 9/04*** | (2006.01) |
| ***H01Q 7/00*** | (2006.01) |
| ***H01Q 5/40*** | (2015.01) |

(52) U.S. Cl.

CPC ..... *H01Q 9/0421* (2013.01); *H01Q 5/40* (2015.01); *H01Q 7/00* (2013.01); *H01Q 9/045* (2013.01)

(58) Field of Classification Search

USPC ..... 343/700 MS

See application file for complete search history.

(56) References Cited

U.S. PATENT DOCUMENTS

| | | | | |
|---|---|---|---|---|
| 3,319,141 | A * | 5/1967 | Cariou et al. | 361/323 |
| 4,741,214 | A * | 5/1988 | Vidmantas | 73/708 |
| 5,262,792 | A | 11/1993 | Egashira | |
| 5,349,365 | A * | 9/1994 | Ow et al. | 343/895 |
| 2003/0160726 | A1 | 8/2003 | Grant et al. | |
| 2004/0051675 | A1 | 3/2004 | Inoue | |
| 2005/0264461 | A1 * | 12/2005 | Sugimoto et al. | 343/713 |
| 2006/0077115 | A1 | 4/2006 | Oh et al. | |
| 2006/0227052 | A1 | 10/2006 | Tavassoli Hozouri | |
| 2007/0285335 | A1 * | 12/2007 | Bungo et al. | 343/895 |
| 2011/0043427 | A1 | 2/2011 | Lee et al. | |

FOREIGN PATENT DOCUMENTS

| | | | |
|---|---|---|---|
| EP | 1 091 445 | A2 | 4/2001 |
| JP | 2006/115448 | A | 4/2006 |
| KR | 10-2009-0104333 | A | 10/2009 |
| KR | 10-2011-00841479 | A | 7/2011 |

OTHER PUBLICATIONS

"Antenna Theory: A Review," Balanis, Proc. IEEE vol. 80 No. Jan. 1, 1992.*

* cited by examiner

*Primary Examiner* — Graham Smith

(74) *Attorney, Agent, or Firm* — Birch, Stewart, Kolasch & Birch, LLP

(57) ABSTRACT

Disclosed is an antenna. The antenna includes a first radiating part bent in a predetermined direction, a second radiating part under the first radiating part, a conductive member connected to the second radiating part, and a coupling part spaced apart from the conductive member while surrounding a lateral side of the conductive member.

13 Claims, 4 Drawing Sheets

Omni-directional

Beam forming

ANTENNA

TECHNICAL FIELD

The disclosure relates to an antenna having a circular feeding structure. In more particular, the disclosure relates to an antenna which can optimize the impedance matching in the power feeding between antennas by utilizing a circular feeding structure, increase the efficiency of the antenna by allowing a feeding line to serve as another antenna, and perform beam forming.

BACKGROUND ART

As antenna technologies have developed from an external antenna to an embedded antenna, small and light antennas have been required.

Since various functions are added to even home appliances as well as the smart phone as the demands for home appliances utilizing a smart phone are increased with the advance of the technology, the small and light antenna has been required. Accordingly, the technology on the small antenna has been continuously performed, and the high-efficiency antenna employing various schemes in a small size has been applied to various wireless appliances.

A radiating element constituting the antenna can be formed with a length corresponding to 4/1 of a wavelength at a resonance frequency in the low frequency band. Compacter antennas for a broad band have been required, and antennas usable in a wider frequency band have been required.

Technical Problem

The disclosure is to provide a high-efficiency small antenna to various wireless appliances by utilizing a conventional feeding line to a circular feeding coupling to act as one independent antenna, so that the feeding line acts as an array antenna together with an antenna mounted on the feeding line.

Technical Solution

According to the embodiment, there is provided an antenna including a first radiating part bent in a predetermined direction, a second radiating part under the first radiating part, a conductive member connected to the second radiating part, and a coupling part spaced apart from the conductive member while surrounding a lateral side of the conductive member.

Advantageous Effects

As described above, the circular feeding coupling antenna of the disclosure has the following effects.

First, the circular feeding coupling antenna is utilized as an antenna different from an antenna mounted on an antenna feeding line, so that the two antennas serves as an array antenna, thereby increasing the antenna efficiency.

Second, a part of an antenna mounted on the feeding line acts as a feeding line antenna, so that the electrical length of the antenna can be reduced.

Third, the impedance matching for a broader band can be achieved by using a coupling.

BEST MODE

Mode for Invention

Figure 1:
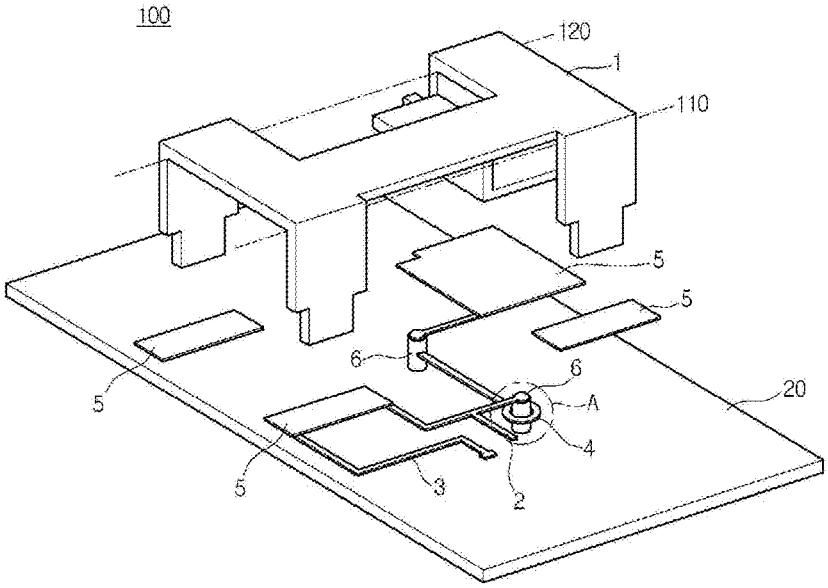
FIG. 1 is an exploded perspective view showing components of an antenna according to the embodiment of the disclosure.

Hereinafter, exemplary embodiments of the disclosure will be described in detail with reference to accompanying drawings. The details of other embodiments are contained in the detailed description and accompanying drawings. The advantages, the features, and schemes of achieving the advantages and features of the disclosure will be apparently comprehended by those skilled in the art based on the embodiments, which are detailed later in detail, together with accompanying drawings. The same reference numerals will be assigned to the same elements throughout the whole description.

Figure 2:
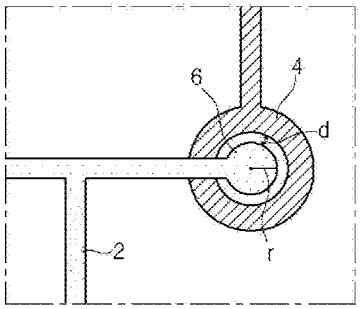
FIG. 2 is a partial enlarged view of a part A of FIG. 1.
Figure 3:
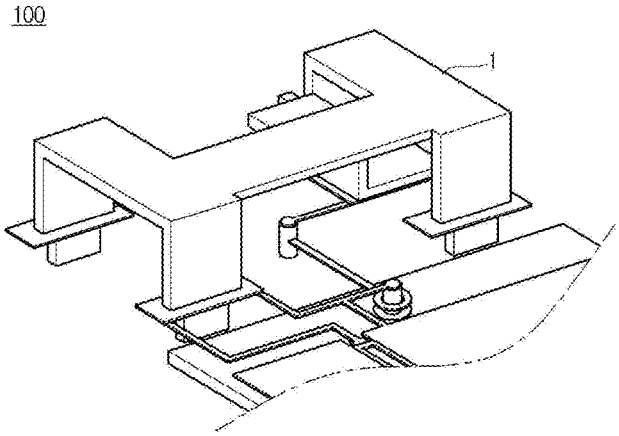
FIG. 3 is a perspective view showing the coupling of the components of an antenna according to the embodiment of the disclosure.

FIG. 1 is an exploded perspective view showing components of an antenna according to the embodiment of the disclosure, FIG. 2 is a partial enlarged view of a part A of FIG. 1, and FIG. 3 is a perspective view showing the coupling of the components of an antenna according to the embodiment of the disclosure.

Referring to FIG. 1, a broadband embedded antenna device 100 according to one embodiment of the disclosure may include an antenna part and a substrate 20. The antenna part may be provided on a feeding part 3.

In addition, the antenna part may include a first radiating part 1, a second radiating part 2, a feeding part 3, a coupling part 4, a first radiating part mounting part 5, and a conductive member 6. The first and second radiating parts 1 and 2 may be connected to a grounding part and the feeding part 3, respectively.

The substrate 20 may include at least one of epoxy, duroid, Teflon, baklite, high-resistance silicon, glass, alumina, LTCC, and air form, but the disclosure is not limited thereto.

The first and second radiating parts 1 and 2 radiate RF signals having a preset frequency band to the outside, and receive RF signals having a preset frequency band from the outside.

The first radiating part 1 is mounted on the first radiating part mounting part 5 so that the first radiating part 1 can be connected to the second radiating part 2. The first and second radiating parts 1 and 2 may include the same material.

The first radiating part 1 may be bent at a right angle along two bending lines 110 and 120. In this case, the two bending lines 110 and 120 may include virtual lines to bend the first radiating part 1.

In this case, the first radiating part 1 may be bent in the same direction along the two bending lines 110 and 120. For example, the first radiating part 1 may be bent at the right angle along the two bending lines 110 and 120. Accordingly, the space necessary to mount an antenna may be reduced. In addition, the first radiating part 1 may include a metallic plate having a meander line structure so that the antenna can be realized in a limited space.

In this case, although the disclosure has been described in that the first radiating part 1 is bent at the right angle, the bending angle of the first radiating part 1 may be more than the right angle or less than the right angle. In addition, the dimension of the first radiating part 1 or the second radiating part 2 may be varied according to the resonance frequency or the wavelength.

The antenna device 100 according to one embodiment of the present invention may include an internal antenna used in a cellular terminal (e.g., mobile communication terminal), or PDA (Personal Digital Assistant).

The resonance in the fundamental band and/or the resonance at a higher band may be additionally provided by the second radiating part 2. In other words, the second radiating part 2 may have a substantially loop shape, so that the resonance in the fundamental band and/or the resonance at a higher band may be additionally provided.

The second radiating part 2 may have the conductive member 6 at the bending part. The second radiating part 2 may be connected in the bending state due to the conductive member 6. In addition, the second radiating part 2 may be connected to the first radiating part mounting part 5.

Referring to FIG. 2, the coupling part 4 may have a closed loop shape (or ring). The coupling structure A may exert an influence on the electrical characteristic (especially, impedance matching) of the antenna device 100 at all frequency bands.

In the coupling structure A, the coupling part 4 and the conductive member 6 are spaced apart from each other by a predetermined distance d to perform impedance matching.

Although the coupling part 4 may have the shape of "O" as show in FIG. 2, the coupling part 4 may have the shape of "C". However, the disclosure is not limited thereto. When the coupling part 4 has the shape of "O", the coupling part 4 may be applied to a stack-type antenna. In addition, when the coupling part has the shape of "C", the coupling part 4 may be applied to a double-side antenna.

Although the conductive member 6 has a cylindrical shape, the embodiment is not limited thereto. The conductive member 6 is connected to the second radiating part 2, and spaced apart from the coupling part.

Since the conductive member 6 electromagnetically exerts an influence on the quantity of coupled energy, the resonance frequency, and the impedance matching state, the whole interval d and a radius r of the conductive member 6 are adjusted by taking the whole size and the internal space of a terminal equipped with an antenna into consideration.

In other words, the interval d and the radius r of the conductive member 6 are variously set, so that the diversity of a capacitor component can be more maximized. Accordingly, the interval d and the radius r of the conductive member 6 may be variously modified and applied. For example, one of the interval d and the radius r of the conductive member 6 may be modified, or both of the interval d and the radius r of the conductive member 6 can be modified.

The second radiating part 2 connected to the coupling part 4 may be horizontal to the second radiating part 2 connected to the conductive member 6.

As described above, impedance matching can be achieved at a broader band through the coupling matching occurring in the structure in which the coupling part 4 is spaced apart from the conductive member 6 by a predetermined distance d.

In other words, a conventional inverse-F antenna has a structure of achieving only point matching through a grounding pin. According to the matching scheme, sufficient matching at a broad band does not occur. In contrast, in the coupling matching structure of the present invention, impedance matching can be achieved at the broader band.

The impedance matching can be achieved due to the capacitor coupling in the coupling structure, and the capacitance may be varied according to the interval d. For example, if the interval d is increased, the capacitance may be increased. In addition, the electrical length of the first radiating part 1 can be reduced due to the coupling structure.

Figure 4:
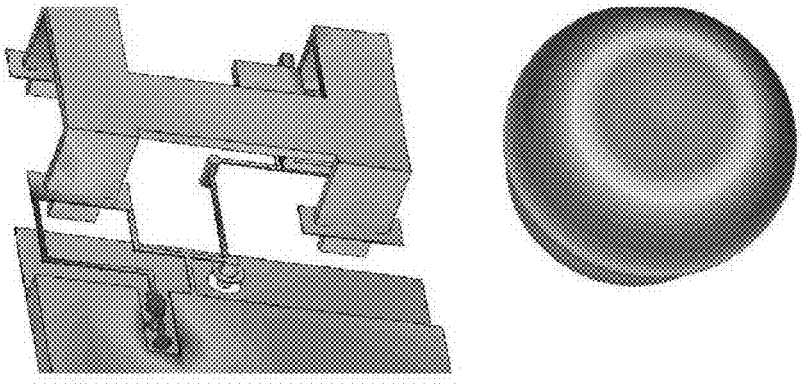
FIGS. 4 and 5 are views showing the radiation shape of the antenna according to the embodiment of the present invention.
Figure 5:
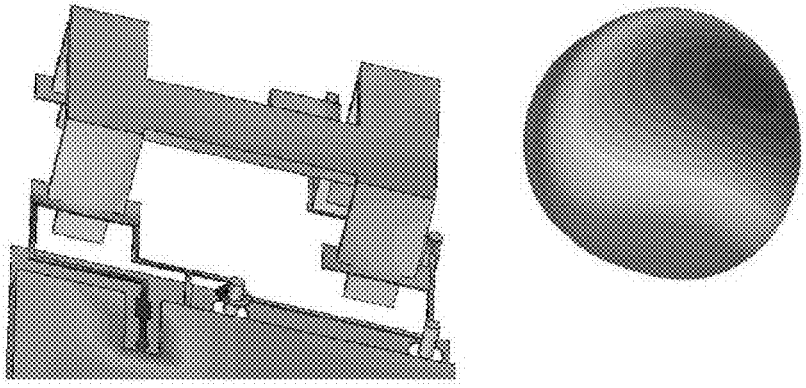

FIGS. 4 and 5 are views showing the radiation shape of the antenna according to the embodiment. FIG. 4 is a view showing an external antenna. As shown in FIG. 4, since an omnidirectional antenna is required, the second radiating part 2 may have a point symmetry structure. If the second radiating part 2 has a point symmetry structure, the coupling part 4 may have the shape of "O".

FIG. 5 is a view showing an embedded antenna. As shown in FIG. 4, since a directional antenna is required, the second radiating part 2 may have a plane symmetry structure. If the second radiating part 2 has a plane symmetry structure, the coupling part 4 may have the shape of "C".

Figure 6:
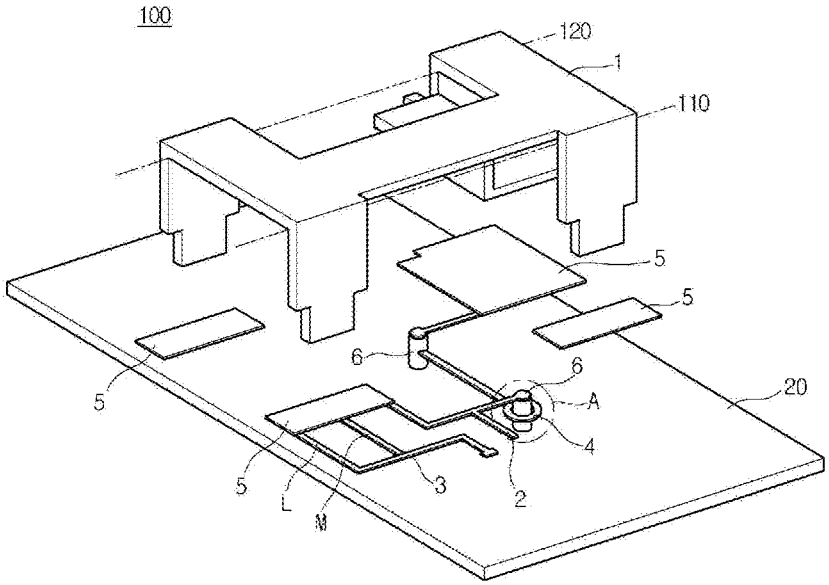
FIG. 6 is an exploded perspective view showing components of an antenna according to another embodiment of the disclosure.

FIG. 6 is an exploded perspective view showing components of the antenna according to another embodiment of the disclosure. Referring to FIG. 6, a plurality of feeding parts 3 are provided, and the feeding part 3 may be connected to the first radiating part mounting part 5. In other words, the feeding part 3 including first and second feeding parts L and M in parallel to each other may be connected to the first radiating part mounting part 5.

The first feeding part L may be aligned in line with the second feeing part M. The first and second feeding parts L and M may have the same width, but the embodiment is not limited thereto. The first and second feeding parts L and M may be formed on the same plane in parallel, or may be formed with a predetermined gradient.

Figure 7:
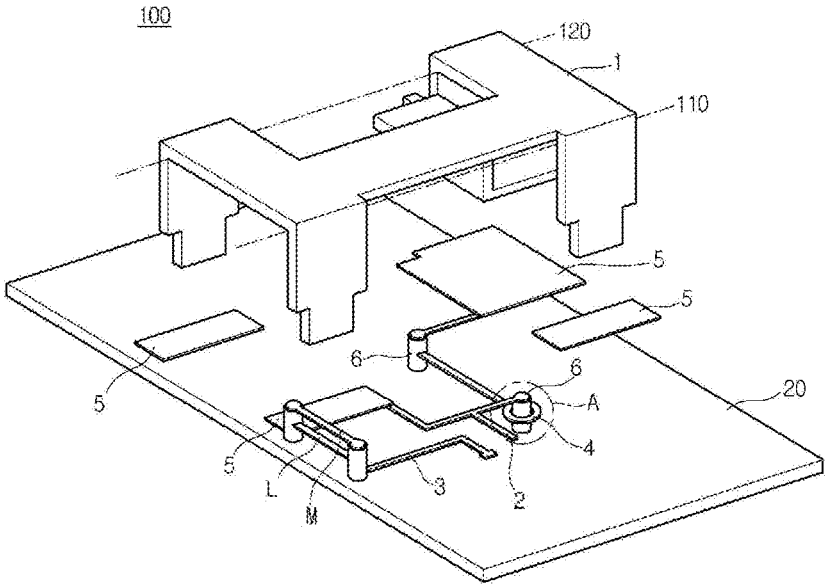
FIG. 7 is an exploded perspective view showing components of an antenna according to still another embodiment of the disclosure.

FIG. 7 is an exploded perspective view showing the components of an antenna according to still another embodiment of the disclosure. Different from the structure shown in FIG. 6, the first and second feeding parts L and M are connected to each other in parallel while forming a predetermined height. The first and second feeding parts L and M may include the same material, and includes a conductive material.

Since a plurality of feeding parts are provided as described above, the size of the antenna may be reduced.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An antenna comprising:

a first radiating part having a top surface and a plurality of legs extending from the top surface;

a plurality of mounting parts, each of the plurality of mounting parts being connected to each of the plurality of legs;

a feeding part connected to one of the plurality of mounting parts; and a second radiating part connected to the one of the plurality of mounting parts and another of the plurality of mounting parts, wherein the second radiating part includes:

a first conductive member;

a coupling part spaced apart from the first conductive member while surrounding a lateral side of the first conductive member;

a first radiating pattern connected to the one of the plurality of mounting parts and the first conductive member; and a second radiating pattern connected to the coupling part and the another of the plurality of mounting parts, wherein the second radiating pattern includes a second conductive member, wherein the coupling part has a circular shape, wherein the coupling part is spaced apart from the first conductive member by a predetermined distance, and wherein the predetermined distance and a radius of the conductive member is modified to perform an impedance matching.

2. The antenna of claim 1, wherein the first conductive member has a cylindrical shape, and wherein the second conductive member has a cylindrical shape.

3. The antenna of claim 1, wherein the second radiating part has a point symmetry structure.

4. The antenna of claim 1, wherein the second radiating part has a line symmetry structure.

5. The antenna of claim 1, wherein the first radiating part is formed by bending a metallic plate having a predetermined width in a multiple bending structure.

6. The antenna of claim 5, wherein a bending angle is a right angle.

7. The antenna of claim 1, wherein the feeding part includes a first feeding part and a second feeding part.

8. The antenna of claim 7, wherein the first feeding part and the second feeding part are connected to each other in parallel.

9. The antenna of claim 7, wherein the first feeding part and the second feeding parting include a same material.

10. The antenna of claim 7, further comprising other conductive members connected to the first feeding part and the second feed part.

11. The antenna of claim 10, wherein the first feeding part and the second feeding part are connected to each other through the other conductive members.

12. The antenna of claim 10, wherein the first feeding part is under the second feed part.

13. The antenna of claim 7, wherein the first feeding part and the second feeding part are formed on the same plane.

* * * * *